US005954256A

United States Patent [19]

Niada

[11] Patent Number: 5,954,256

[45] Date of Patent: Sep. 21, 1999

[54] DISPENSER FOR DISPENSING PAPER UPON MANUAL TEARING FROM A ROLL, WHEREIN THE DISPENSER IS PROVIDED WITH A SECOND ROLL IN RESERVE

[75] Inventor: Gianandrea Niada, Milan, Italy

[73] Assignee: QTS S.r.l., Milan, Italy

[21] Appl. No.: 08/973,025

[22] PCT Filed: Apr. 29, 1997

[86] PCT No.: PCT/IT97/00098

§ 371 Date: Nov. 26, 1997

§ 102(e) Date: Nov. 26, 1997

[87] PCT Pub. No.: WO97/41764

PCT Pub. Date: Nov. 13, 1997

[30] Foreign Application Priority Data

May 2, 1996 [IT] Italy ..... MI96A 0859

[51] Int. Cl.[6] ..... B26F 3/02; B65H 16/04

[52] U.S. Cl. ..... 225/34; 225/39; 225/47; 242/560; 242/598.6; 312/34.22; 312/34.23

[58] Field of Search ..... 242/560, 594.5, 242/598.6; 312/34.22, 34.23; 83/650, 946, 949; 225/34, 37, 38, 39, 40, 42, 46, 47, 53, 77, 90, 94, 96; 221/45, 33; 220/501, 507

[56] References Cited

U.S. PATENT DOCUMENTS

| | | | |
|---|---|---|---|
| 3,050,224 | 8/1962 | Drolshammer . | |
| 3,276,706 | 10/1966 | House . | |
| 3,865,295 | 2/1975 | Okamura | 225/47 |
| 4,398,656 | 8/1983 | McCadden | 225/47 |
| 4,872,601 | 10/1989 | Sigmund | 225/38 |
| 5,058,792 | 10/1991 | Morand | 225/42 |
| 5,265,816 | 11/1993 | Collins . | |
| 5,645,244 | 7/1997 | Moody | 242/560 X |
| 5,765,740 | 6/1998 | Ferguson | 225/39 X |

FOREIGN PATENT DOCUMENTS

| | | | |
|---|---|---|---|
| 0298931 | 1/1989 | European Pat. Off. | 225/46 |
| 2 620 020-A1 | 3/1989 | France . | |
| 2 627 071-A1 | 8/1989 | France . | |

*Primary Examiner*—Rinaldi I. Rada
*Assistant Examiner*—Boyer Ashley
*Attorney, Agent, or Firm*—Panitch Schwarze Jacobs & Nadel, P.C.

[57] ABSTRACT

A container device that dispenses paper from a roll, with a roll (B) in reserve. The device has two substantially parallel pins (4,4') for supporting and unwinding paper (10) from the rolls (A, B) with two openings (20) corresponding to the pins in the lower portion of the device contained within a housing. A sector (5) shaped as part of a circle is mounted to freely rotate about one of the pins. The sector (5) has a peripheral flange (5*a*) that is adapted to obstruct the corresponding opening (20). When the sector (5) is kept at a first, substantially vertical position, the opening (20) is obstructed. A spring (15) urges the sector (5) to rotate until reaching a second position at which point, the previously obstructed opening (20) is made accessible. A lever (6) is provided to keep the sector (5) in a first position until a thumb follower (8), attached to the lever (6) comes into contact with the core of the roll upon roll exhaustion, whereby the sector (5) rotates to a second position making the opening (20) accessible.

12 Claims, 4 Drawing Sheets

Fig. 1
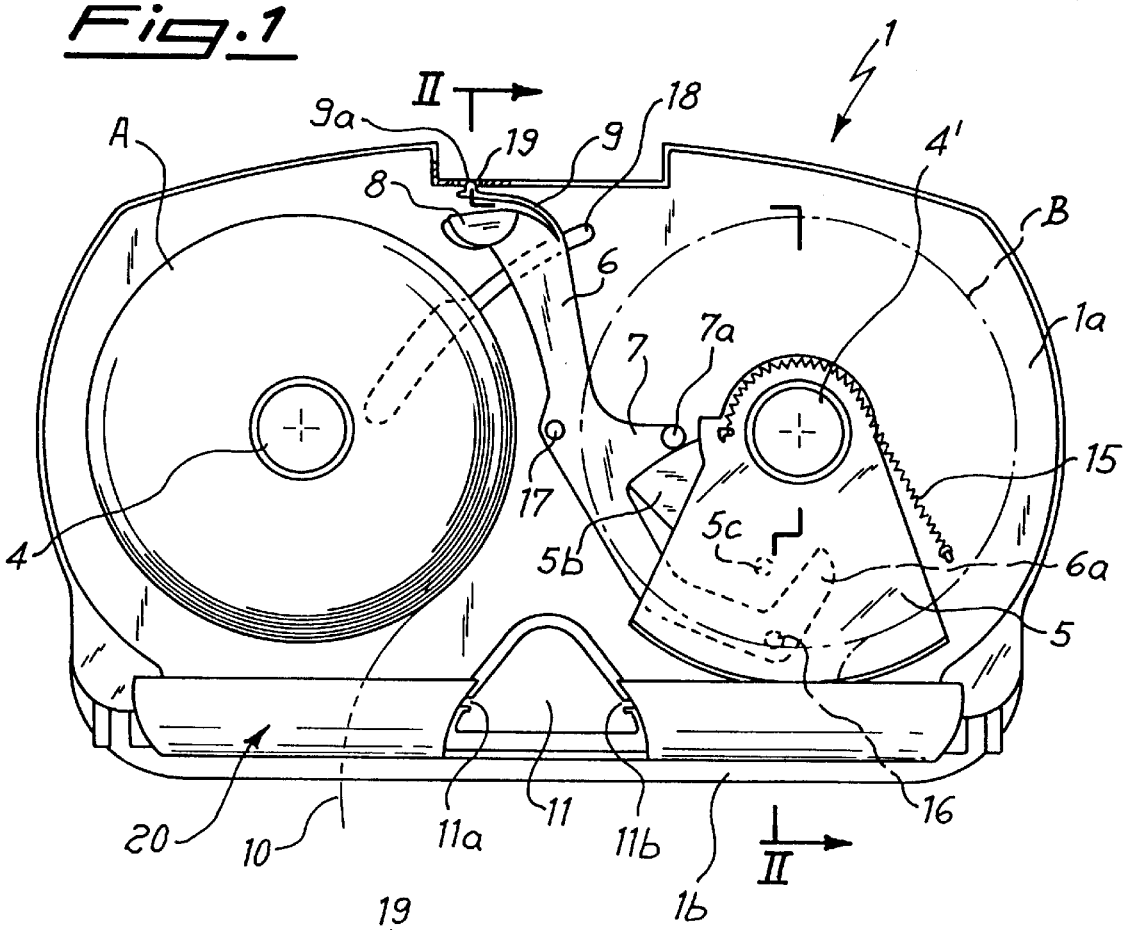
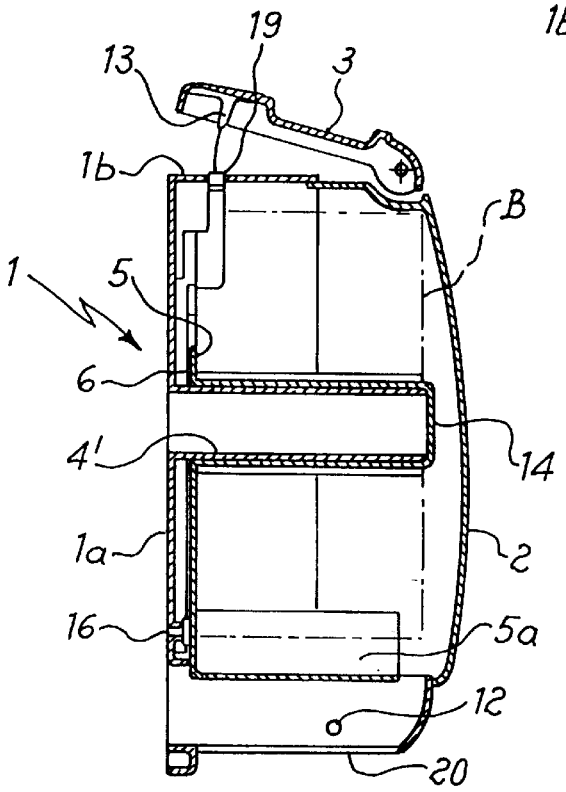
Fig. 2

DISPENSER FOR DISPENSING PAPER UPON MANUAL TEARING FROM A ROLL, WHEREIN THE DISPENSER IS PROVIDED WITH A SECOND ROLL IN RESERVE

BACKGROUND OF THE INVENTION

The present invention relates to a container-dispenser of single lengths of paper dispensed by manual tearing from a continuous paper web wound up to form a roll, suitable to include two rolls at a time, one of which is in reserve.

Paper dispensers are known, in particular of toilet paper but also for the use as towels, which are wall-mounted in public places such as the rest rooms of motorway snack-bars, railway stations, airports, restaurants, etc., where the paper consumption is very high and the rolls are so frequently replaced that a very careful control is required whenever the paper rolls in reserve are not to be left directly available to the users for the replacement, with the consequence of unavoidable waste of material. In order to reduce the interventions of the personnel charged with the replacement, sometimes dispensers of toilet paper or towels have been adopted which are suitable to contain a pair of paper rolls, one of which in reserve, in such a way that a better store is available between one replacement and another. Usually in these known devices the two rolls are in turn accessible from the outside and it is the same user that displaces a slidable shutter, when a roll is finished, to make it possible to have access to the other. Of course there is no hindrance, however, that the user may take paper, no matter whether from one of the other roll by simply moving the shutter, until a possible suitable situation takes place in which both the rolls are partially exhausted and the person who has to carry out the replacement must choose between leaving the things as they are, with the risk that before a subsequent intervention all the paper is taken away from both the rolls, or carrying out an early replacement with unavoidable waste of material.

SUMMARY OF THE INVENTION

In order to avoid doubtful situations of this type, in which both the solutions would be disadvantageous, it has now been conceived, being the object of the present invention, a device for dispensing paper lengths from a roll, which is adapted to contain two paper rolls at a time, wherein the withdrawal is automatically ensured from the same preferential side. Thereafter the other side becomes accessible and the withdrawal can then be performed from the second roll in reserve, preferably until a fresh roll is inserted in the preferential exhausted side.

This main object of the present invention is obtained by means of a container-dispensing device for lengths of paper from a roll, having an external housing formed of a stationery portion and a cover, two pins substantially parallel, as support for unwinding from two rolls with two openings for the passage of paper in the lower part of the housing in correspondence with the pins, and having freely rotatable about one of the pins a sector of a circle member having a peripheral flange shaped as an arc of circle and adapted to obstruct the corresponding opening on the same side, as long as the sector is kept in a first substantially vertical position against the bias exerted by spring means tending to bring the sector to a second rotated position of rest, in correspondence of which the opening on the same side is freely accessible, there being provided means adapted to keep the sector in its substantially vertical position until thumb follower, fixed to the means and constantly in contact with the outer surface of a roll unwinding about the pin, come substantially in contact with the core of the roll itself, thus causing the sector to trigger to the second rest position under the bias of the spring means.

According to other particular aspects of the present invention, the inside of the device is inaccessible by the user during its normal operation and the relevant cover is fixed to the rear wall of the device itself by means of a central stiffening member having also the function of ashtray.

BRIEF DESCRIPTION OF THE DRAWINGS

These and other objects, advantages and features of the device according to the present invention will appear clearer from the following detailed description of the preferred embodiment thereof, given by way of non-limiting example with reference to the annexed drawings in which:

FIG. 1 shows a schematic, front view of the device according to the invention with cover removed and in a situation preceding its functioning, wherein two fresh rolls have been just placed or at least only one in the seat of normal dispensing (on the left-hand);

FIG. 2 shows a sectional view along the line II—II of FIG. 1, wherein the cover has been considered closed and an upper stiffening and blocking member is near its lowered position;

DETAILED DESCRIPTION OF THE INVENTION

Figure 3:
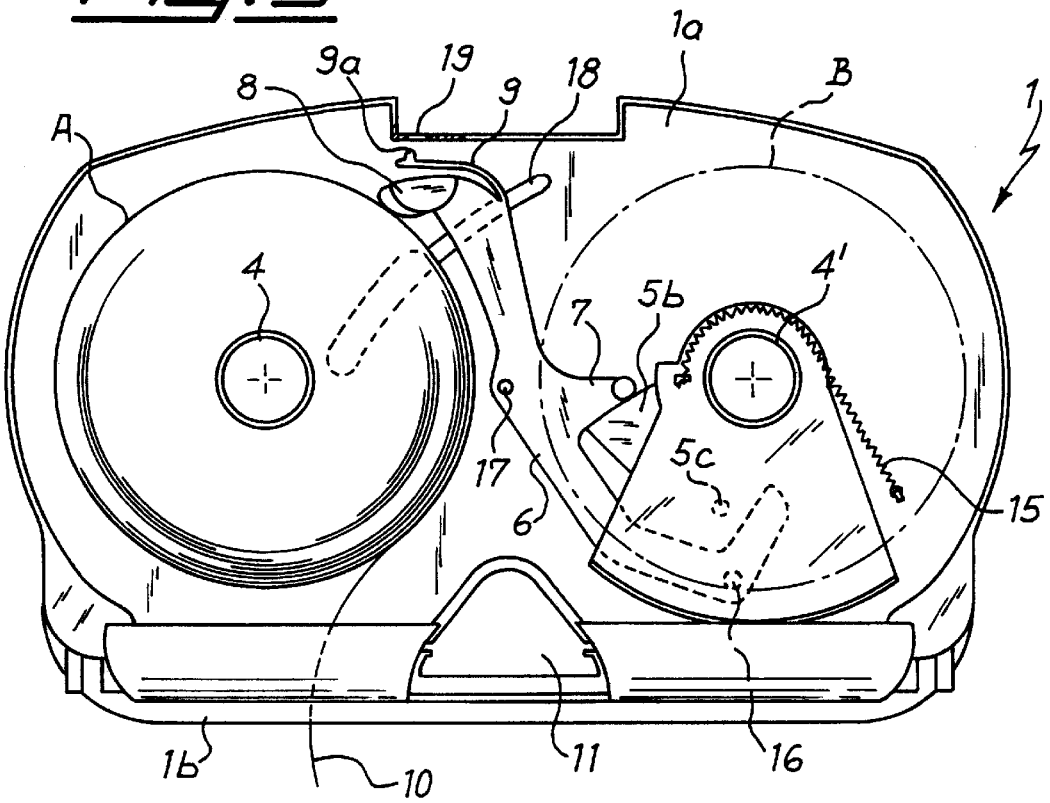
FIG. 3 shows a view similar to that of FIG. 1, in which the preliminary step of loading the device is over and its normal working can start.

With reference to the drawings, the device has an external housing formed of a stationary portion 1 comprising a rear wall 1*a*, integral with a peripheral lip 1*b* and provided with wall fastening means, as well as a front covering lid 2 pivotedly mounted at 12 in its lower side to the stationary portion 1. A member 3 is pivotedly mounted on the upper side of the cover 2, and adapted to fit in a hollow seat formed in the cover itself and in the upper portion of the wall 1, thus mutually coupling these two portions and stiffening the assembly. Preferably member 3 is shaped with such a hollow to make it have the shape and the functions of an ashtray.

Two cylindrical pins 4, 4', substantially parallel to each other, protrude outwards from the rear wall, possibly formed integrally with the wall itself by moulding, which are adapted to provide the unwinding support for two paper rolls, A and B respectively, being housed within the container formed of said stationary wall 1 and cover 2, when closed. The lower portion of the lip 1*b* has two openings or elongated through holes 20 which extend parallel to the two pins 4, 4' in a substantially underlying zone, corresponding to the same pins. Through said openings the free end of paper 10 coming from the respective roll A or B is caused to be accessible from the outside to be withdrawn and torn off by the user in the desired length. Furthermore, still in the lower zone of the container, centrally between the two passages 20 there is preferably provided a chamber 11 substantially shaped as a rounded triangle for dividing the inner space of the container in two seats, right- and left-hand, associated to the two rolls A, B. This chamber 11 is hollow and accessible at its inside, with cover 2 open, with the possibility of housing a deodorizing pill, preferably supplied in a net-type container (not shown) of triangular shape, homologous to that of the chamber 11, in which it can be placed by means of guides 11*a* and 11*b* for releasing deodorizing vapours in the environment.

Figure 5:
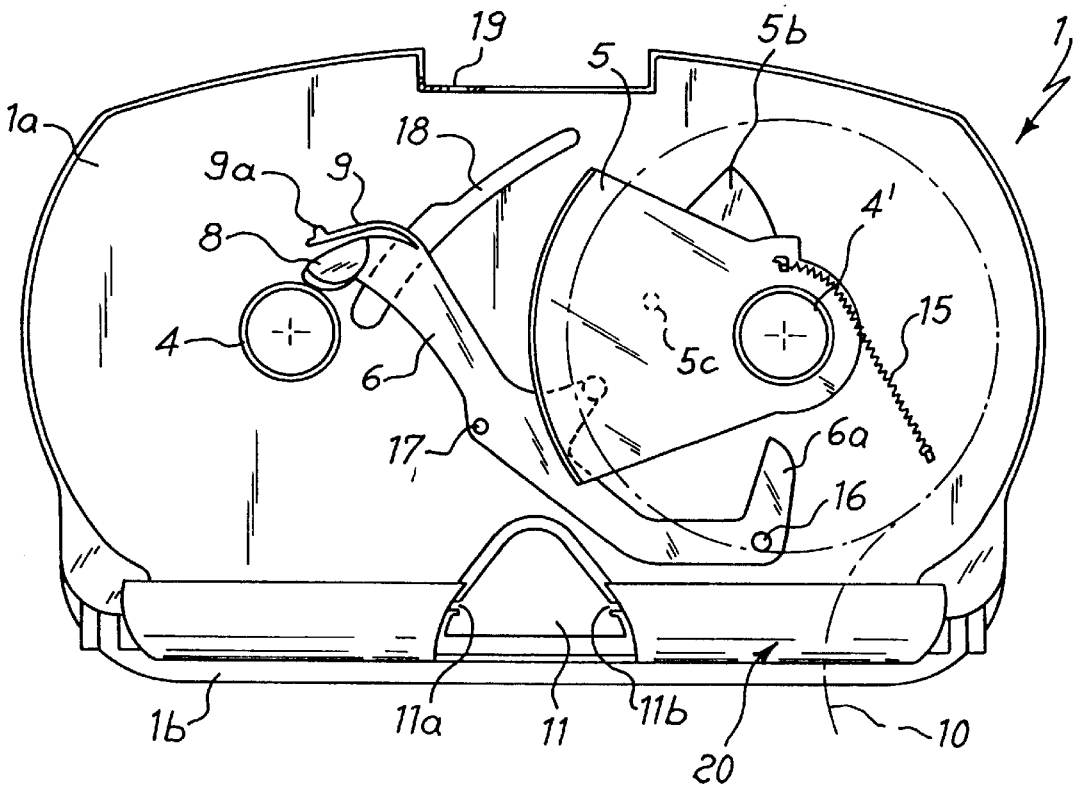
FIG. 5 shows again a similar view in a situation immediately subsequent to that of FIG. 4, wherein the roll in reserve (on the right side) is accessible to the users.
Figure 6:
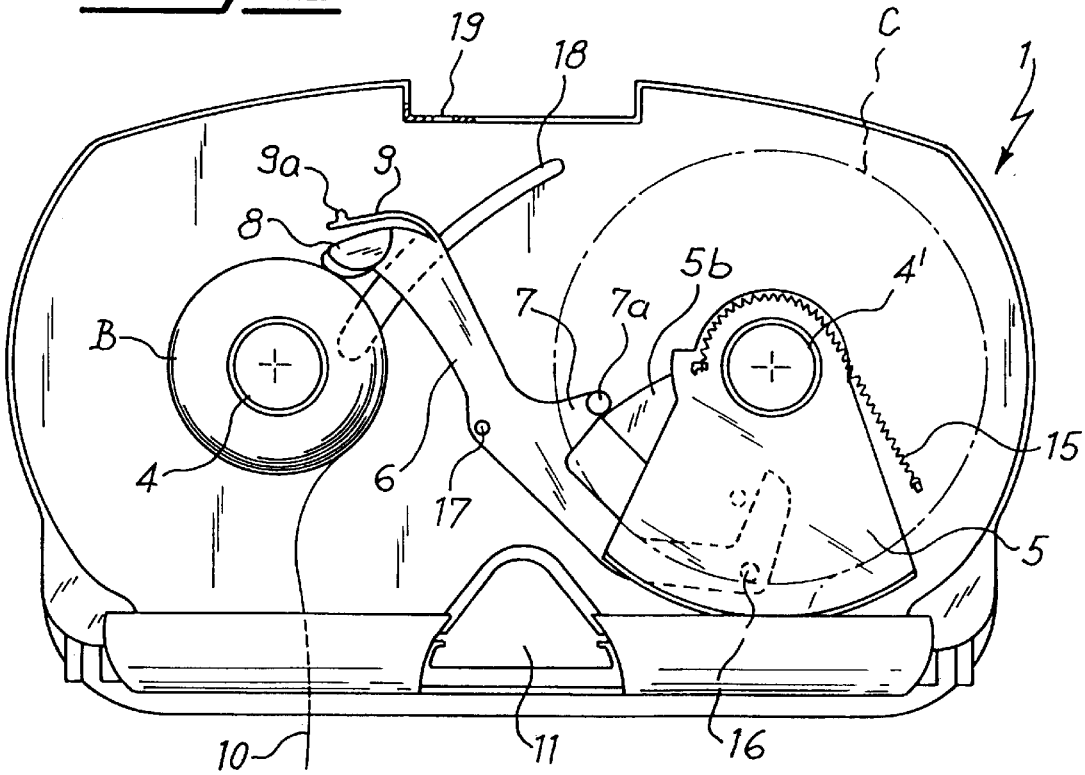
FIG. 6 shows, again in the same view, a situation in which the paper withdrawal newly occurs on the left-hand side where the roll originally on the right has been displaced, while a fresh roll in reserve has been placed on the right-hand side.

More in particular, according to the present invention, on one of the two pins 4, 4', namely the right one as shown in the drawings, there is mounted freely rotatable as a ring a member 5 having a shape of sector of a circle, whose peripheral edge is shaped as an arc of circle and extends frontly for a length sufficient to obstruct, except than in the position of FIG. 5, the corresponding underlying hole 20 communicating to the outside. This sector 5 is prevented from moving along the pin 4' by a positioning and blocking cap or plug 14 being fitted from the outside onto the pin itself and adapted to keep the sector 5 in a position nearer the rear or back wall 1*a*. Of course the thickness of sector 5 and of the cap 14 are such as to allow in any case the insertion of roll B with its core, while the vertical wall of sector 5 is sufficiently near to the back wall 1*a* not to cause any hindrance in the axial direction, whereby the paper roll is entirely comprised within the container with cover 2 closed and the distance of the protruding peripheral flange 5*a* from the axis of pin 4' cannot cause obstacles in the radial direction, thus allowing the roll to be housed without problems. A spring 15 is fixed under tension at an end to the sector 5 and at the other end to the back 1*a* of the device to normally bias the sector 5 to the position of FIG. 5 in which the lower opening 20 communicates the outside with the roll B.

In the other working situations, the sector 5 is instead always kept in the position at which the opening 20 is obstructed through the engagement of the lever 6 with a cam-shaped side portion 5*b* of the section 5. The active profile of the latter corresponds, when the sector 5 is in the intercepting vertical position, to an arc of circle having the center at a point 16 which is coincident with the fulcrum of lever 6. At the end of a shaped dependent portion 7 with a lower profile corresponding to that of cam portion 5*b*, the lever 6 is provided with a member for engagement with said cam, preferably a roller 7*a*, to hold the sector 5 in the intercepting vertical position against the bias of spring 15 as long as sector 5 and lever 6 are in contact, in other words there is contact between cam 5*b* and roller 7*a*.

Figure 4:
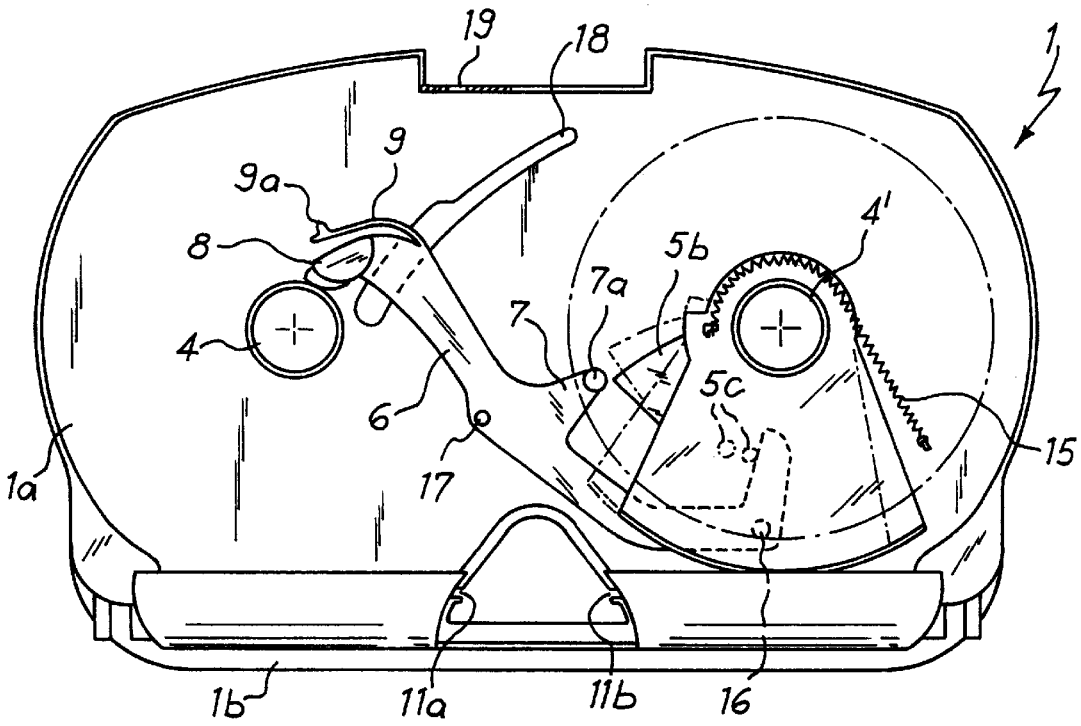
FIG. 4 shows again a view similar to those of FIGS. 1 and 3, in a situation of complete exhaustion of the roll of normal dispensing.

It will be appreciated that fulcrum 16 is placed near the lower end of lever 6 and this latter extends in a plane behind sector 5, as is shown in the embodiment of FIG. 2, being provided at the opposite end with a contact member 8, preferably of rounded thumb-shape, capable of resting by gravity onto the roll A which is mounted on the left pin 4, where there is no intercepting sector 5. Such a thumb 8 is preferably formed, not integrally with lever 6, of two members of different thickness being fixed side by side, and can be fitted at the end opposite to the fulcrum 16 in two alternative orientations, thus being directed towards the contact surface with two different thicknesses according to the core size of the roll in use. Therefore, when adopting rolls with a core of greater diameter, the contacting end 8 of lever 6 will be fixed in such a way to come into contact with the core in correspondence with the same angle formed by lever 6 about fulcrum 16 (FIG. 4) as with a core of smaller diameter, whereby it will be the portion of thumb 8 with lower thickness to come into contact with roll A, while the orientation will be opposite when rolls are used with a lesser diameter size of the core, in order to have contact with the thicker portion of a thumb.

According to a preferred embodiment of the device of the invention, the upper end of lever 6, formed downwards with the follower thumb member 8, bifurcates upwardly with a flexible tang member 9 provided with a tooth 9*a* protruding upwards and adapted to fit in a corresponding slot 19 formed in the upper portion of the frontally projecting lip 1*b*, thus being able to fit in such a slot and hold the lever in the raised position as represented in FIG. 1. Such a slot 19 is preferably formed in the hollow area provided as seat of the blocking and stiffening member 3 with possible functions of ashtray. This latter in turn has a pin 13 (FIG. 2) directed downwards, adapted to fit in said slot 19 to close and kept blocked in position the cover 2 on which the member 3 is pivotedly mounted. On the other hand, if in the slot 19 the tooth 9*a* of lever 6 has been already inserted from underneath, the entry of pin 13 from above would cause its ejection, thus consequently releasing the lever which, rotating around the pivot 16 by gravity, would stop at the position in which, according to the active thickness chosen at the moment of fitting the thumb on the lever, such a thumb touches the surface of the left roll A.

Figure 7:
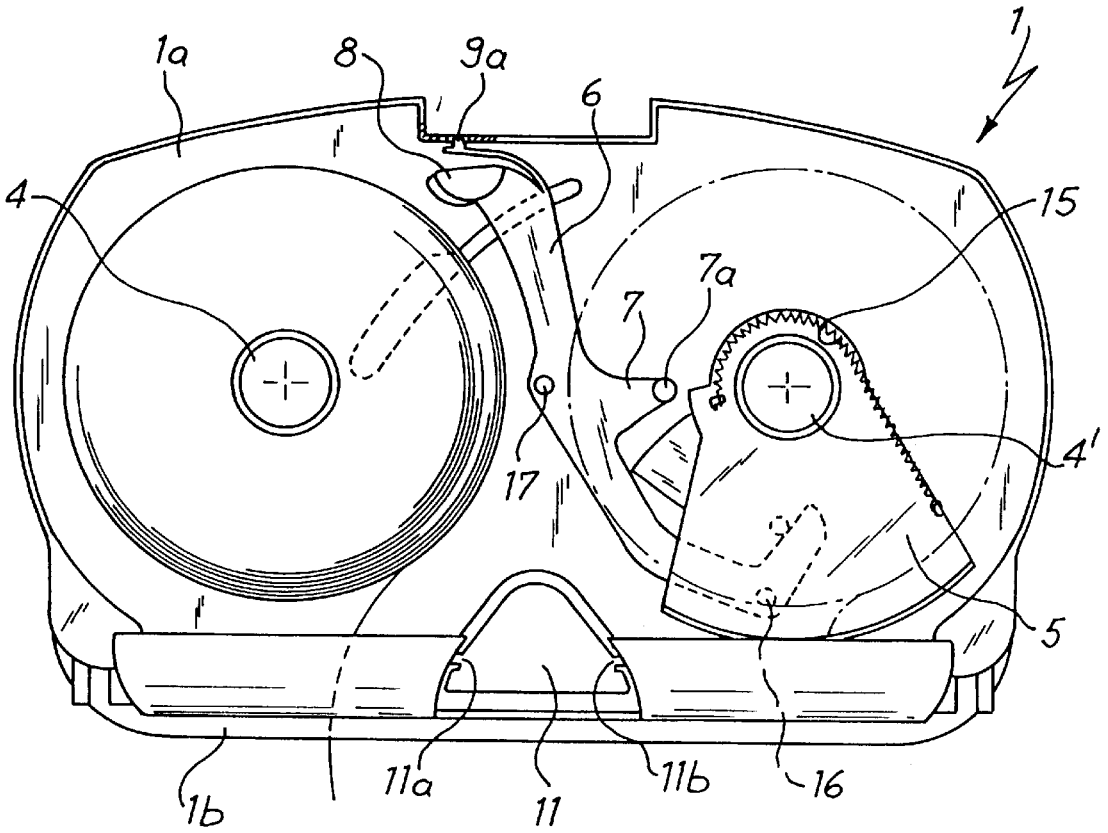
FIG. 7 shows a situation in preparation to the one of FIG. 1 or however preliminary to the replacement of a roll in the left seat.

The lever 6 is also formed, at a nearly middle length, with a pawl 17 directed to the outside and adapted to engage the flange 5*a* of sector 5 when this is positioned as in FIG. 5 and the lever 6 is positioned as shown in FIGS. 1 or 7. There is preferably provided a guide 18 for the lever 6, as required by the flexibility of the latter due to its relative length, thus avoiding possible oscillations during the movement of the lever itself.

It will be finally appreciated that lever 6, at the end at which it is pivoted in 16, preferably is formed with a tail portion 6*a* facing upwards and adapted to come into engagement, when the left roll A is completely empty, with a pawl 5*c* integral with the rear portion of sector 5.

It clearly appears from the foregoing that the device according to the invention has one side for housing a roll in reserve and another side for housing the roll from which the paper is normally withdrawn. The "reserve" side is that on which the intercepting sector 5 is mounted, which in the illustrated case has been considered on the right side, but of course the relative positions could be inverted.

The device operation will now be better explained in the following description. Upon initially charging the device with the two rolls A, B, as represented in FIG. 1, lever 6 must be brought to the position indicated, with the tooth 9*a* in the upper slot 19 in order not to interfere with the loading of the rolls, in particular the roll A. In order to bring the lever 6 to this position, action is previously made onto the sector 5 by causing it to rotate in anticlockwise direction against the tension of spring 5, thus engaging with its pawl 5*c* the tail 6*a* of lever 6 which, by rotating in clockwise direction about fulcrum 16, reaches the position as indicated, then keeping such a position during the paper rolls charging. Subsequently the cover 2 is closed and blocked onto the stationary portion 1 by lowering member 3, having also an ashtray function, which with its pin 13 fits into the slot 19 and at the same time pushes away therefrom the tooth 9*a*, whereby the lever 6 is disengaged and drops by gravity with its follower thumb 8 onto the surface of roll A. As previously stated, the thumb 8 will have been preliminarly mounted onto the lever 6 in such a way to present to the contact the portion of greater or lesser thickness depending on whether the core of the used rolls is respectively of smaller or greater diameter, since usually two standard sizes are foreseen for such a diameter. Through the opening 20 on the left side an end portion of paper 10 from the roll A is accessible from the outside and its supply to the users can start while, on reduction of the diameter in consequence of the roll unwinding, the follower thumb 8 drops and lever 6 rotates in a counterclockwise direction about its fulcrum 16, while the roller 7*a* at the end of its appendix 7 moves with slightest friction, along the profile of cam 5*b* of sector 5, thus keeping the latter in the vertical position of FIG. 3 against the tension bias exerted by spring 15. Since the cam 5*b* profile has a substantially arc of circle shape, with center in 16, during the lever 6 rotation there is no movement of sector 5 by virtue of lack of any eccentricity.

Upon complete exhaustion of the roll A (FIG. 4) and the follower thumb 8 being in contact with the roll core, the roller 7*a* and cam 5*b* are no longer in contact; thereby the spring 15 can exert its tension bias onto the sector 5 making the same to rotate in clockwise direction until a neutral position of rest or possibly against a stop (not shown), substantially as represented in FIG. 5. In this situation the opening 20 on the right side is no longer obstructed by the lower flange 5*a* of the rotatory sector, and thereby a paper length is made accessible to the outside, being dispensed from the roll B in reserve from which the users can then take paper until the subsequent intervention of the personnel in charge.

This intervention is preferably performed by bringing to the left side the roll B in reserve, already partially utilized, and inserting on the store side, the right one, a fresh roll C (or introducing two fresh rolls if the roll B is already almost exhausted). It will be appreciated that in order to mount the roll B (or a fresh one) on the left side of normal distribution, the lever 6 must be brought again to the initial position of FIGS. 1 and 7, whereby the sector 5 will have to be previously brought to the vertical interception position and, to avoid that this may happen due to a mere inadvertence, the pawl 17 has been provided, which would abut against the peripheral lip of the sector itself thus preventing lever 6 from lifting. In this way any possibility is excluded that both openings 20 may be accessible at the same time and that the user can choose at which side to take the paper: the withdrawal should be normally carried out always from the same preferential side except for the situation in which the roll on this side is completely empty and therefore the roll in reserve on the other side has become available, but as soon as the normal situation has been reestablished, the stored roll is excluded from possible withdrawals of paper.

As already stated above, auxiliary elements of the device according to the invention are the ashtray 3 mainly having functions of blocking and stiffening of the structure, as well as the deodorizing cavity 11 whose content is accessible from the outside only with open cover.

Possible additions and/or modifications can be brought by those skilled in the art to the above-described and illustrated embodiment of the device according to the invention without exceeding from the scope of the invention itself. In particular different shapes could be adopted for the sector 5 and lever 6 and possibly provided additional auxiliary elements.

I claim:

1. In combination:

first (A) and second (B) rolls of paper said rolls of paper, comprising a center core wrapped with a web of paper, such that said rolls of paper have an outer surface, a dispensing device for dispensing lengths of paper from one of the first and second rolls of paper, said dispensing device comprising:

an external housing formed of a stationary portion (1) having first and second openings (20) for passage of paper (10), said first and second rolls of paper being rotatably mounted within the stationary portion on first and second pins (4,4'), respectfully, said first and second openings of the stationary portion being respectively aligned with the first and second pins;

a sector (5) being freely rotatable about the second pin and having a peripheral flange (5*a*), the sector (5) being movable between a first position, wherein the sector obstructs the second opening, and a second position, wherein the sector is positioned away from the second opening causing the second opening to become accessible;

a spring (15) interconnected between the sector and the housing and biasing the sector toward the second position;

a pivotally mounted member (6) having a roll engagement surface at a first end (8) and a sector engagement surface at a second end, wherein said roll engagement surface contacts said outer surface of said first roll and said sector engagement surface contacts said sector when the sector is in the first position, the member being constructed and arranged to keep the sector in the first position until the roll engagement surface at the first end of the member substantially contacts the center core of the first roll of paper, whereby causing the sector engagement surface at the second end of the member to disengage from the sector such that the sector rotates to the second position under the bias of the spring.

2. The combination according to claim 1, wherein said roll engagement surface of said first end (8) of said member (6) has a rounded shape and has contact portions of different relative thicknesses including a generally thicker portion and a generally thinner portion, said contact portions being in a direction generally parallel to an axis of rotation of the first roll, the roll engagement surface of the first end of the member being attached to said member (6) with either the thicker portion or the thinner portion oriented to contact the first roll.

3. The combination according to claim 1 further comprising a substantially triangular hollow chamber (11), the chamber being integral with the stationary portion (1) of the housing and centrally located between the first and second openings (20) and having an interior accessible when the cover (2) of the housing is in an open position, the interior of the chamber being adapted to house a deodorizing element.

4. The combination according to claim 1 wherein the stationary portion of the housing further comprises a cover (2) with a closure and blocking member (3) wherein the blocking member (3) is pivotally mounted on a front side of the cover and has a generally downwardly projecting pin (13) adapted to fit into a corresponding slot in the stationary portion (1) of the housing.

5. The combination according to claim 4, wherein said closure and blocking member (3) provides a stiffening structure and has an ashtray.

6. The combination according to claim 1, wherein said member (6) further includes a fulcrum (16) and engagement members (7, 7*a*), said fulcrum is disposed at the second end of the member and is coincident with the sector when the sector is in the first position, said engagement members are constructed and arranged between said first and second ends of the member such that the engagement members engage the sector and maintain the sector in the first position.

7. The combination according to claim 6, wherein the second end of said member (6) has a tail (6*a*) extending beyond said fulcrum (16), said sector (5) being integrally provided with a pawl (5*c*) that protrudes from a rear surface of the sector (5), said tail (6*a*) being adapted to engage the pawl (5*c*) when the sector (5) is rotated towards the first position.

8. The combination according to claim 6, further comprising a guide (18) that cooperates with the member (6) to limit oscillations.

9. The combination according to claim 6, wherein the engagement members of said member (6) include a roller (7*a*) disposed at a distal end of an appendage (7); said sector (5) has a side cam (5*b*) of a generally arc-shaped profile and said roller (7*a*) being adapted to follow said side cam (5*b*) as said first end of said member (6) moves in response to changes in the diameter of the first roll (A) whereby said roller (7*a*) disengages with said cam (5*b*) when said roller (7*a*) reaches an end of said profile thereby releasing the sector from engagement with the appendage (7).

10. The combination according to claim 9, wherein said member (6) includes a pawl (17) located adjacent said transverse appendage (7) and opposite to said roller (7*a*), said pawl (17) facing generally frontwards and adapted to engage the peripheral flange (5*a*) of said sector (5) when the sector is in the second position.

11. The combination according to claim 9, further including a tooth (9*a*) at said first end of said member, the tooth facing generally upward and adapted to fit into a corresponding slot (19) formed in the housing (1) when the member (6) is held in a raised position during insertion of a fresh roll of paper or a partially used roll of paper on said first pin (4).

12. The combination according to claim 11 wherein a generally downwardly projecting pin (13) is adapted to enter said slot (19) of said housing release said generally upwardly projecting tooth (9*a*) of said member (6) from a raised position.

* * * * *